US008627885B2

(12) United States Patent
Adam et al.

(10) Patent No.: US 8,627,885 B2
(45) Date of Patent: Jan. 14, 2014

(54) NON-COLLAPSING BUILT IN PLACE ADJUSTABLE SWAGE

(75) Inventors: Mark K. Adam, Houston, TX (US); Keven M. O'Connor, Houston, TX (US); Jeffrey C. Williams, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 1018 days.

(21) Appl. No.: 12/496,138

(22) Filed: Jul. 1, 2009

(65) Prior Publication Data

US 2011/0000664 A1 Jan. 6, 2011

(51) Int. Cl.
*E21B 23/00* (2006.01)

(52) U.S. Cl.
USPC ..... 166/216; 166/206; 166/380; 166/381

(58) Field of Classification Search
USPC ..... 166/206, 207, 216, 217, 378, 380, 381
See application file for complete search history.

(56) References Cited

U.S. PATENT DOCUMENTS

| | | | | |
|---|---|---|---|---|
| 3,067,801 | A * | 12/1962 | Sortor | 29/522.1 |
| 3,191,677 | A * | 6/1965 | Kinley | 166/277 |
| 3,198,955 | A * | 8/1965 | Schaefer | 307/413 |
| 4,848,964 | A * | 7/1989 | Yarnell | 405/184.3 |
| 5,086,838 | A | 2/1992 | Cassel et al. | |
| 6,012,526 | A | 1/2000 | Jennings et al. | |
| 6,041,860 | A | 3/2000 | Nazzal et al. | |
| 6,446,724 | B2 | 9/2002 | Baugh et al. | |
| 6,561,271 | B2 | 5/2003 | Baugh et al. | |
| 6,607,032 | B2 | 8/2003 | Voll et al. | |
| 6,619,696 | B2 | 9/2003 | Baugh et al. | |
| 6,631,765 | B2 | 10/2003 | Baugh et al. | |

(Continued)

FOREIGN PATENT DOCUMENTS

| | | |
|---|---|---|
| EP | 2322753 A2 | 5/2011 |
| WO | 9802638 | 1/1998 |

(Continued)

OTHER PUBLICATIONS

Lopez Lara, Alejandro, et al., "Expandable Screens: Optimized Horizontal Gas Production Through Collaboration" OTC 19341, May 2008, 1-9.

(Continued)

*Primary Examiner* — Jennifer H Gay
*Assistant Examiner* — Elizabeth Gitlin
(74) *Attorney, Agent, or Firm* — Steve Rosenblatt

(57) ABSTRACT

A swage is made from segments that slide relatively to each other to go from a run in dimension to a maximum or built dimension when the segments move into alignment. The angle of inclination of the sliding axis between the members is less than the swaging angle for the pipe on the exterior of the segments so that once the segments are aligned and driven into a tubular for swaging they are precluded from extending into misalignment to clear an obstruction. In this manner a minimum drift is provided or the swage simply stalls. The swage in a tubular goes to the predetermined maximum dimension using the sliding surfaces that are at an angle to bear the radial reaction forces from the tubular more directly, thereby reducing the contact forces and the resulting friction. The edge connections reduce bending which can cause segment binding as the swage is built in the tubular.

29 Claims, 5 Drawing Sheets

(56) References Cited

U.S. PATENT DOCUMENTS

| | | | | |
|---|---|---|---|---|
| 6,792,665 | B2 | 9/2004 | Baugh et al. | |
| 6,814,147 | B2 | 11/2004 | Baugh | |
| 6,915,852 | B2 | 7/2005 | Baugh et al. | |
| 7,036,582 | B2 | 5/2006 | Cook et al. | |
| 7,044,231 | B2 | 5/2006 | Doane et al. | |
| 7,114,559 | B2 | 10/2006 | Sonnier et al. | |
| 7,117,949 | B2 | 10/2006 | Doane et al. | |
| 7,124,826 | B2 | 10/2006 | Simpson | |
| 7,128,146 | B2 * | 10/2006 | Baugh et al. | 166/206 |
| 7,134,504 | B2 | 11/2006 | Doane et al. | |
| 7,140,430 | B2 * | 11/2006 | Wubben | 166/207 |
| 7,156,182 | B2 | 1/2007 | Lynde et al. | |
| 7,222,669 | B2 | 5/2007 | Sonnier et al. | |
| 7,422,068 | B2 | 9/2008 | Lynde | |
| 7,520,335 | B2 | 4/2009 | Richard et al. | |
| 7,562,714 | B2 | 7/2009 | Lynde et al. | |
| 7,607,476 | B2 | 10/2009 | Tom et al. | |
| 7,661,470 | B2 | 2/2010 | Doane et al. | |
| 7,784,797 | B2 | 8/2010 | Baugh et al. | |
| 7,900,717 | B2 | 3/2011 | Radford et al. | |
| 8,281,854 | B2 | 10/2012 | Gaudette et al. | |
| 2005/0121203 | A1 | 6/2005 | Richard et al. | |
| 2005/0161213 | A1 | 7/2005 | Sonnier et al. | |
| 2005/0161229 | A1 | 7/2005 | Doane et al. | |
| 2006/0254779 | A1 | 11/2006 | Lynde | |
| 2007/0277971 | A1 * | 12/2007 | Garcia | 166/206 |
| 2008/0053656 | A1 | 3/2008 | Lynde et al. | |
| 2010/0044029 | A1 | 2/2010 | Lynde et al. | |
| 2010/0116490 | A1 | 5/2010 | Lynde et al. | |
| 2011/0174481 | A1 | 7/2011 | Gaudette et al. | |

FOREIGN PATENT DOCUMENTS

| | | | |
|---|---|---|---|
| WO | 0223009 | A2 | 3/2002 |
| WO | 03050386 | A2 | 6/2003 |
| WO | 03054349 | A2 | 7/2003 |
| WO | 03069115 | A2 | 8/2003 |
| WO | 03069118 | A2 | 8/2003 |
| WO | 2005056979 | A1 | 6/2005 |
| WO | 2008006009 | A1 | 1/2008 |
| WO | 2008070052 | A2 | 6/2008 |
| WO | 2008118697 | A2 | 10/2008 |
| WO | 03076763 | A2 | 9/2009 |
| WO | 2011090916 | A1 | 7/2011 |

OTHER PUBLICATIONS

Aal, Tharwat Abdel, et al., "One-Trip Expandable Screen Installation Solves Water and Sand Management and Gas Production Issues in Nile Delta", IPTC 11797, Dec. 2007, 1-.

Stockmeyer, Carl F., et al., Monobore Expandable Liner Extension Saves Well with Problematic Drilling Programme from Abandonment:, SPE 141285, May 2011, 1-14.

Stockmeyer, Carl F., et al., "Monobore Expandable Liner Extension Deployment Saves Well from Abandonment", SPE 141221, Sep. 2011, 1-14.

* cited by examiner

NON-COLLAPSING BUILT IN PLACE ADJUSTABLE SWAGE

FIELD OF THE INVENTION

The field of this invention is mechanical expansion swages and more particularly the type that use segments that move relatively in an axial direction to build and hold a predetermined dimension during expansion.

BACKGROUND OF THE INVENTION

Pipe expansion is done with swages that have a variety of designs. The swage can be a cone of a fixed dimension that is pushed through a pipe to place the pipe in tension or it can be pulled through the pipe to place the pipe in compression during the expansion. When using a fixed swage driven uphole one way is to provide a bell with the fixed swage below the tubular to be expanded and overlap the tubular to be expanded with another already in the well. A ball is dropped to close off a compartment below the swage that can be pressured up to drive the swage uphole. This technique is illustrated in U.S. Pat. No. 7,036,582. These designs are complex to build and run into a wellbore and have a possible downside of getting the swage stuck while driven uphole with no simple way to remove the assembly.

Other swage devices use radially extendable rollers that are hydraulically powered coupled with rotation of the swage and a pull or push through the tubular being expanded. These devices can be bulky making them difficult to use in the smaller sizes and develop enough power to build in place by roller extension driven by applied hydraulic pressure. One such example is U.S. Pat. No. 7,124,826.

Another adjustable swage design involves interlocking segments that translate axially with respect to each other. When the segments are pushed into alignment they are at their maximum or built diameter and can be advanced through a tubular. If the segmented swage runs into an obstruction the segments can move axially relatively to each other to assume a smaller dimension to get past an obstruction where for reasons of wellbore conditions the pipe will not give enough to let the swage pass in the fully built diameter configuration. The original design is shown in U.S. Pat. No. 7,114,559 and related patents. To make this design more compliant to obstructions on one portion of the tubular but not all the way around it, the edge connections were modified to a more of a ball and socket design from the original L-shaped interlocking design to make the assembly more compliant. This modified design is shown in U.S. Pat. No. 7,128,146.

The present invention is an improvement to the known segmented swage design shown in U.S. Pat. Nos. 7,114,559 and 7,128,146. In one aspect it reconfigures the segments as they are joined for relative edge movement by inclining the sliding axis such that once the segments are built to maximum dimension they will not collapse or act in a compliant manner so as to reduce the created drift diameter in applications that require a minimum drift to pass other tools at a later time. The edge to edge connection is configured to minimize relative rotation between adjacent segments at their sliding interface to reduce the potential for binding during relative motion on diameter change. The orientation of the load transfer surface between segments is also configured to transfer more of the reaction force in building the swage to its target diameter in a tubular to a more radial direction to reduce the normal component of force on surfaces that slide relatively so as to reduce the friction force from such sliding to make it possible to get to the built configuration with less force applied. These and other aspects of the present invention will be more apparent to those skilled in the art from a review of the detailed description of the preferred embodiment and the associated drawings with the understanding that the full scope of the invention is determined by the attached claims.

SUMMARY OF THE INVENTION

A swage is made from segments that slide relatively to each other to go from a run in dimension to a maximum or built dimension when the segments move into alignment. The angle of inclination of the sliding axis between the members is less than the swaging angle for the pipe on the exterior of the segments so that once the segments are aligned and driven into a tubular for swaging they are precluded from extending into misalignment to clear an obstruction. In this manner a minimum drift is provided or the swage simply stalls. To facilitate building the swage in a tubular to the predetermined maximum dimension, the sliding surfaces are configured at an angle to bear the radial reaction forces from the tubular more directly thereby reducing the contact forces and the resulting friction. The edge connections are also configured to reduce bending which can cause segment binding as the swage is built in the tubular.

DETAILED DESCRIPTION OF THE PREFERRED EMBODIMENT

Figure 1:
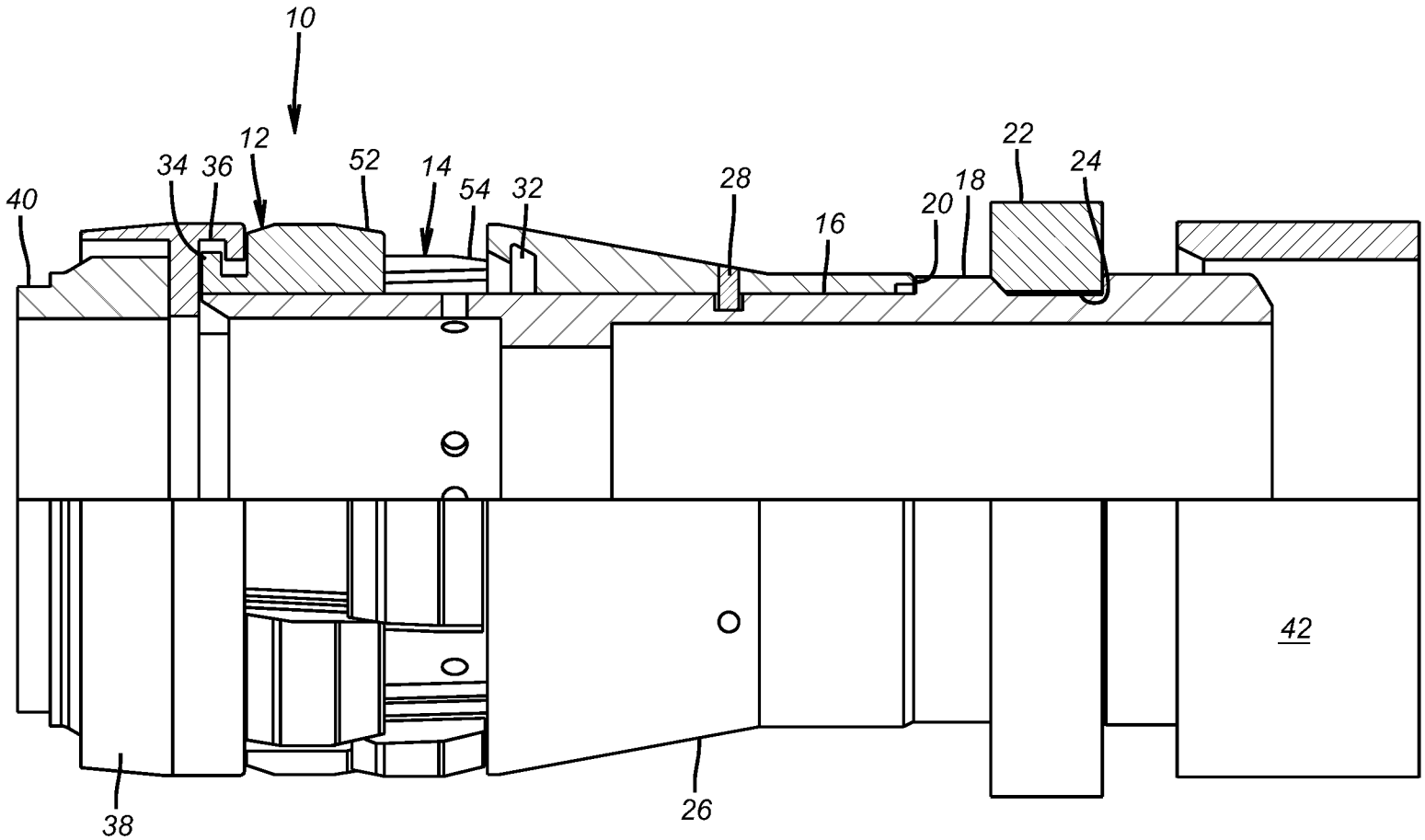
FIG. 1 shows a run in position of the adjustable swage showing an optional lead cone.
Figure 2:
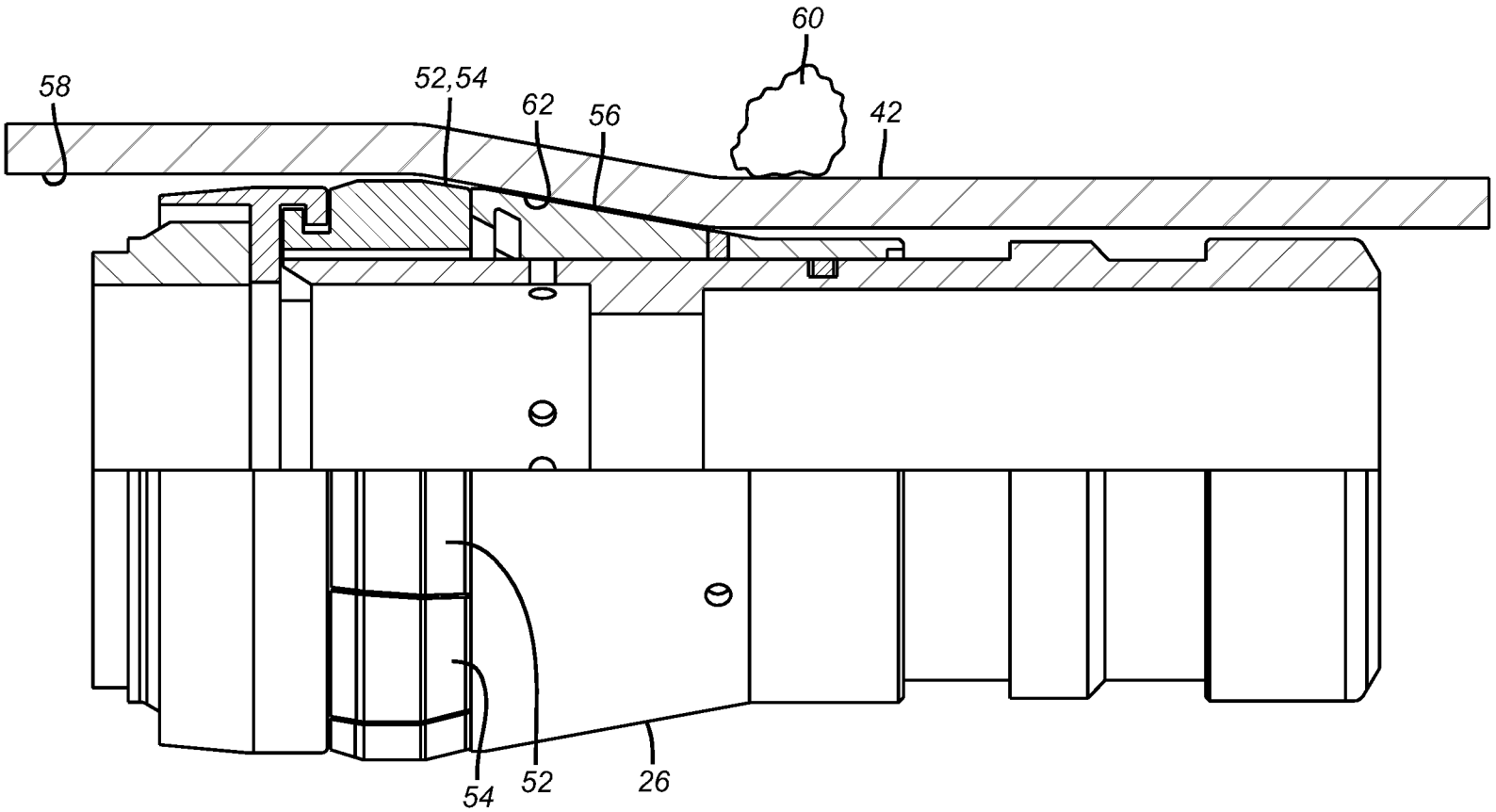
FIG. 2 is the swage of FIG. 1 in the built position for swaging.
Figure 4:
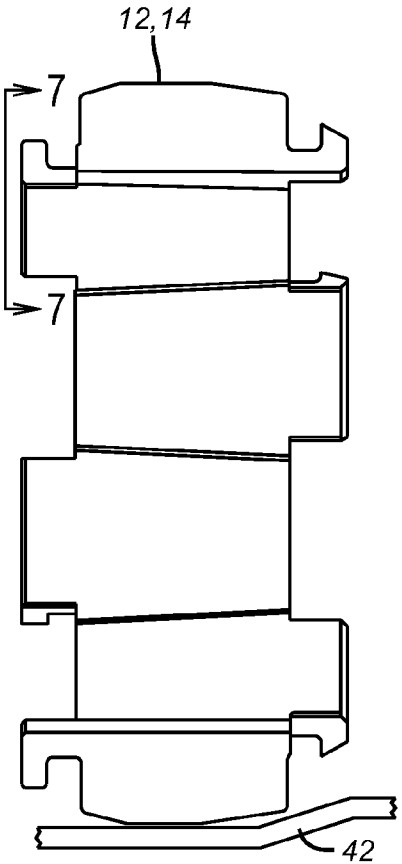
FIG. 4 is the view of FIG. 3 in the swaging position.
Figure 3:
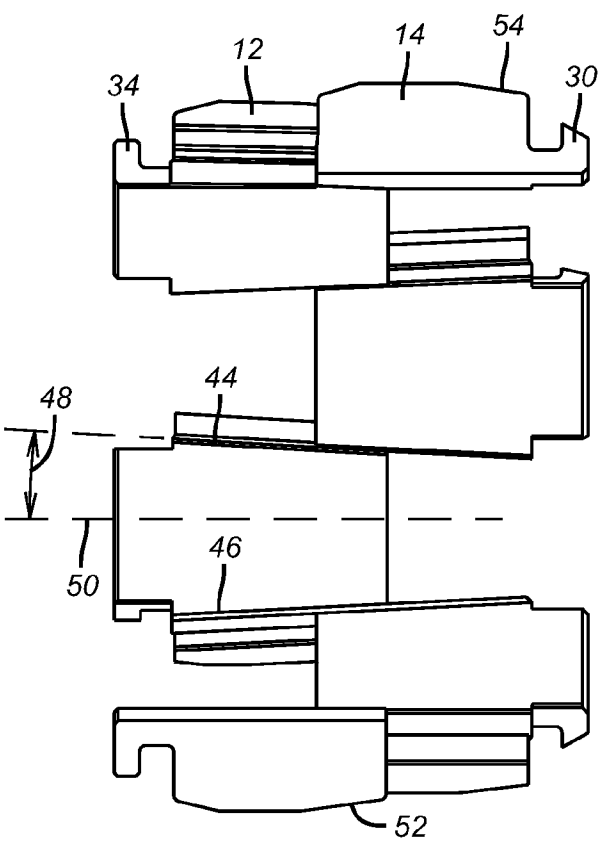
FIG. 3 is a section view of the segments in the run in position.
Figure 7:
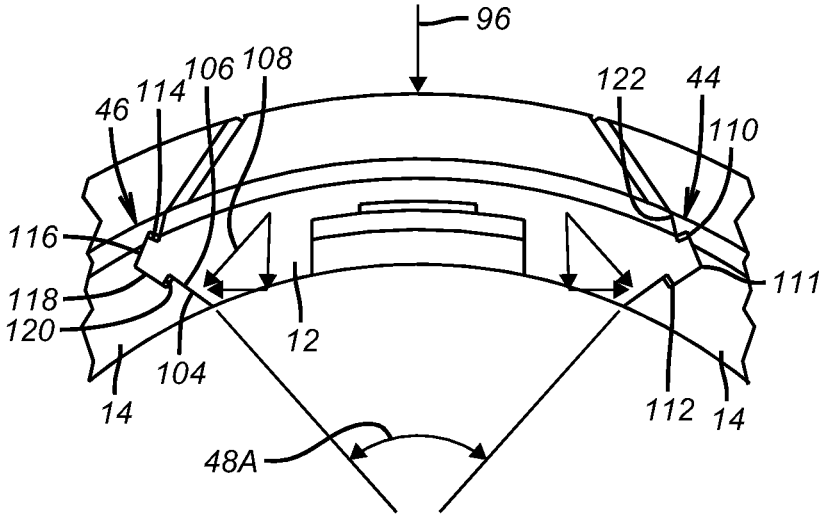
FIG. 7 shows the end connection between segments of the present invention using sharper angles than in the FIG. 6 prior art design.

Referring to FIGS. 1 and 3 together it can be seen that the adjustable swage 10 is made of segments 12 and 14 that are oppositely oriented and in an alternating pattern. The array of segments is disposed on an outer surface 16 of a support sleeve 18 that has an exterior shoulder 20. An assembly clamp 22 that sits in a groove 24 in outer surface 18 is removed before running in the hole. A fixed lead cone 26 is secured against shoulder 20 using shear pins 28. Lower segments 14 have l-shaped mountings 30 and although not shown in FIG. 1 are retained in groove 32 of the lead cone 26. Upper segments 12 have an l-shaped mount 34 that is retained in groove 36 of the body 38. Located above and schematically illustrated as 40 are preferably a hydraulic anchor and stroker supported by a string so as to advance the assembly shown in FIG. 1 into a tubular liner or casing string or a hanger shown schematically as 42. Omitted from FIG. 1 to aid clarity is an upper tubular through which the assembly of FIG. 1 has been advanced to reach the string or hanger 42 to be expanded into contact with the larger tubular that is disposed around it so that after expansion the two strings contact each other for support of the string or hanger 42. This technology is not only limited to expandable liner strings that are connected to previous strings as it can be used to deploy open hole cladding that is not connected. FIG. 3 shows a sliding axis 44 and another sliding axis 46 on opposed flanks of the segments 12. The abutting segments 14 have complementary flank profiles to facilitate sliding contact as best seen in FIG. 7 which is a view along lines 7-7 of FIG. 4 showing the built position. The slant angle 48 between the either axis 44 or 46 preferably at a smaller angle from the central axis 50 than the lead swaging surface 52 of segments 12 and the lead swaging surface 54 of segments 14 make with the central axis 50. In the built position of FIG. 4 the surfaces 52 and 54 are aligned as better seen in FIG. 2. The significance of these angular relationships will be fully explained below.

Figure 5:
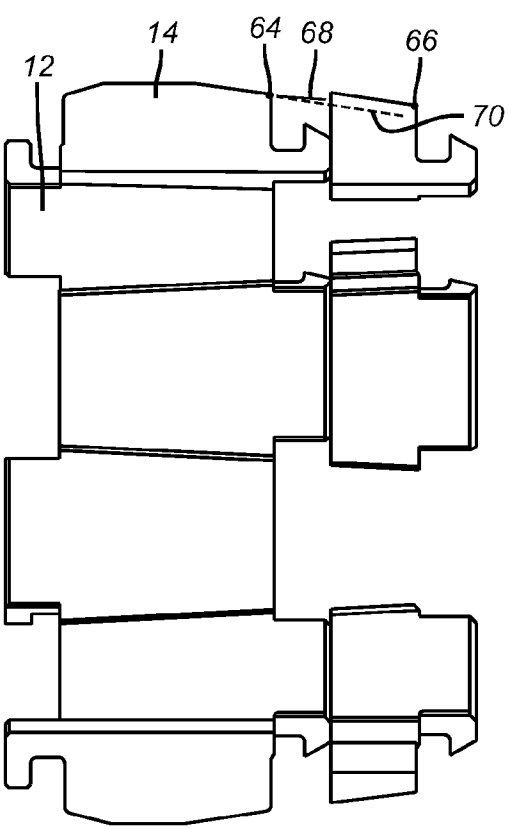
FIG. 5 is similar to FIG. 3 showing why the assembly will not collapse for an obstruction during swaging.

The travel is not defined directly according to 44 and 46, but is a product of this relationship and the angle 48A shown in FIG. 7. The callouts 44, 46 and 48A define the segments' geometric relationship. The rise angle or angle of travel from FIG. 5 is the critical angle for preventing compliance on restriction. This rise angle can be visually seen as the angle between the axis and line 68. It is defined as the diameter change versus axial movement. Items 44 and 46 define more closely the circumferential change relative to axial movement. They are linearly related, but different.

The offset position of the segments 12 and 14 represents their smallest diameter for run in. They go to their maximum diameter by relative axial movement between segments 12 and 14 along a path that results from the flank geometry such as angle 48 and 48A that connect them as better seen in FIG. 7. During run in with the lead cone 26 shear pinned to sleeve 18 with pins 28 impacts to the cone 26 will not change the relative positions of the segments 12 and 14 and cause them to go to the built position at the intended swaging diameter as shown in FIG. 2. However, when the cone 26 lands on the tubular liner or hanger 42 a force is generated to break the shear pins 28 as the sleeve 18 continues to advance. Continuation of applied force to the body 38 causes relative movement of segments 12 with respect to the now stationary segments 14 until the fully aligned position of FIGS. 2 and 4 is obtained. As seen in FIG. 2, the lead cone 26 had initiated expansion of the string 42 along its face 56 which is substantially aligned with now aligned swaging surfaces 52 and 54. As a result of movement of the assembly in the FIG. 2 position, the enlarged inside diameter 58 is obtained.

If an obstruction schematically illustrated as 60 is encountered outside the tubular 42 that is being expanded the assembly 10 will not be able to get smaller by going back to the configuration of FIG. 1 or 3. It could only do so by axial extension of segments 14 being able to move downhole relative to segments 12. In the past, allowing this movement was specifically desirable so that the swaging with a segmented swage design could continue by getting smaller at the obstruction to clear it and then going back to full swaging diameter when the obstruction was cleared. However, in some swaging applications there is a need for a minimum drift diameter as represented by 58 that has to equal or exceed a minimum value to allow tools for subsequent operations to pass through. In these applications any compliant flexibility of the swage assembly 10 is not desirable. It is for this reason that the rise angle as visualized in FIG. 5 as axis of relative movement 68 representing the travel of the segments with respect to radial and axial position as a result of the geometry of the flanks 44 and 46 such as angles 48 and 48A is at a shallower or smaller angle than the pipe angle 70 adjacent both the lead cone 26 if used and the leading swaging surfaces 52 and 54. Because the rise angle defining the relative movement between segments 12 and 14 is at a shallower angle than that of the surrounding pipe, any attempt by segments 14 to move axially relative to segments 12 so as to reduce the outer diameter of the swage assembly 10 will be blocked by the steeper angle of the surface 62 on the tubular or hanger 42 because it has been expanded at a steeper angle as defined by the angle of the lead cone 26 and segments 52 and 54. FIG. 5 illustrates this concept graphically. Points 64 and 66 demonstrate the start and theoretical end position of the leading end of segments 14 as they move relatively to segments 12 along the axis of relative movement 68. The solid line 68 is the travel line between the points 64 and 66. However the dashed line 70 represents the pipe angle of inclination which is at a steeper slope than the line 68. The intersection of those two lines is the limit that segments 14 can move forward to re-establish the FIG. 3 position. It should be appreciated that the segments 14 encounter the slanted surface 62 of tubular 42 virtually immediately to limit if not eliminate the ability of forward relative movement of segments 14 with respect to segments 12. In short, if there is an immovable obstruction 60 the swage assembly 10 will simply stall due to its inability to get smaller by forward relative movement of segments 14 with respect to segments 12. Either enough force can be applied to get the desired minimum diameter by overcoming the obstruction 60 to get the minimum drift 58 or the expansion operation will stop and other techniques could be used to overcome the obstruction 60 or the project may need to be reconfigured to route the string 42 in a different direction to get around the obstruction. The present invention assures that the cone remains built on existing tubular when lead cone becomes unloaded.

Figure 6:
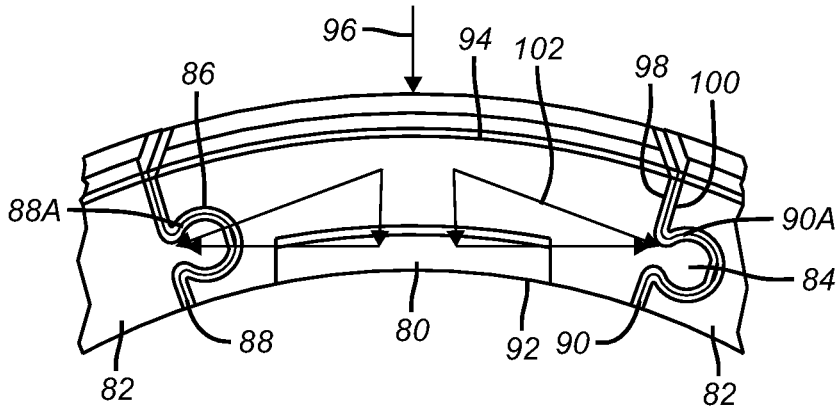
(PRIOR ART) FIG. 6
FIG. 6 shows a prior art end connection between segments and a shallow cut angle.

Apart from configuring the segments 12 and 14 so as not to reduce in diameter at an obstruction 60 there are other features in the edge connections that reduce frictional resistance to relative axial movement and a new tongue and groove configuration to reduce the tendency toward bending between adjacent segments that can jam the adjacent segments together and prevent the alignment of the segments 12 and 14 in the FIGS. 2 and 5 positions. Turning first to FIG. 6 a prior art design shown in U.S. Pat. No. 7,128,146 in FIG. 4 where the edge connections between adjacent segments 80 and 82 are illustrated in an end view. Segment 80 has an elongated rounded male projection 84 running down one side and the inverse of an elongated female rounded indentation 86 on the opposite side. On opposed sides, segments 82 have complementary shapes. The engaged shapes have a gap 88, 90 that extends from the inside surface 92 to the outer surface 94. These gaps exist because the manufacturing method for making the segments is to start with a tubular shape and cut from one end the patterns shown in FIG. 6 with a known cutting technique called wire EDM. The gaps are closed when the cone is built and loaded. The cutting technique removes metal to make the cut shapes illustrated leaving gaps between them that can even be increased in width as shown in U.S. Pat. No. 7,128,146 when the objective is to increase flexibility to go out of round to deal with an obstruction outside the tubular to be expanded so that the swage assembly of FIG. 6 can continue past the obstruction and the inside diameter where the obstruction was located will be smaller than the expanded diameter circumferentially removed from where the obstruction was encountered. Again in applications where a minimum drift is required this type of bending compliance to reduce diameter in a portion of the expanded circumference is not desired. Additionally, while this configuration allows for compliance in the assembly to clear an obstruction, it can also create sufficient bending to cause binding. Another issue with this design is the force transfer of the reaction force of the tubular being expanded as represented by the arrow 96. In FIG. 6 the component of the radial force represented by arrow 96 that acts perpendicular to the contact surfaces 98 and 100 on adjacent segments 80 and 82 and is schematically represented to indicate its proportionate size by arrow 102. Since the angular offset in the planes of the radial reaction force of arrow 96 and surfaces that contact 98 and 100 is so small, a significant contact force is developed that creates a friction force that needs to be overcome and which can limit the relative axial movement of the segments 80 and 82 with respect to each other and could cause binding in extreme cases. One objective of the present invention is to minimize this contact force between segments to reduce the friction force that needs to be overcome. Another objective is to minimize flexing in the side connections between adjacent segments to also reduce the possibility of binding in situations of high loading.

FIG. 7 illustrates the preferred way that these goals have been met. The radial reaction force from the surrounding tubular is again illustrated as 96. This time the opposing contact surfaces 106 on segment 12 and 104 on adjacent segment 14 that are disposed symmetrically on with respect to each segment edge are at a far greater angle approaching 45° so that the normal component 108 of the radial reaction force 96 that creates the contact force between surfaces 104 and 106 is far smaller than in the FIG. 6 design where the plane of the surfaces 98 and 100 is closer to about 10° that for the same reaction force 96 yields a normal force 102 far greater than normal force 108 in the FIG. 7 configuration. As a result, all other things being equal, the friction force to be overcome from a given radial reaction force 96 is greatly reduced.

The actual connection between the segments 12 and 14 is more an arrowhead shape in FIG. 7 as compared to the rounded shapes 84 and 86 that interact in FIG. 6 or the L-shapes that interact in U.S. Pat. No. 7,114,559 in FIG. 8. While the rounded interlocking configuration of FIG. 6 in this application provided for relative bending as a desired feature, the L-shapes that interlocked with the gaps that resulted from wire EDM cutting still had the capability to bend at that connection. The design of FIG. 7 that looks like an arrowhead uses spaced apart acute to right angles 110 and 112 that are disposed symmetrically about an angle 111 that is preferably at least a right angle and preferably an obtuse angle that despite some gap created by the wire EDM manufacturing process keeps the adjacent segments 12 and 14 better aligned and is a much stronger connection against bending radially in or radially out. There are for example four contact surfaces on an edge of a segment such as 12 in FIG. 7; 114 and 116 that define angle 110 and 118 and 120 that define angle 112. Apart from these surfaces on segment 12 there is also the contact surface 106 as well as sloping surface 122 on the outer side of the arrowhead shape that engage their opposed surface to resist bending between segments far better than an interlocking L-shape shown in U.S. Pat. No. 7,114,559.

Those skilled in the art will appreciate that the use of a lead cone 26 is optional and is preferred for applications that will build the swage assembly 10 outside the tubular string or hanger 42. In applications where the assembly is to be built to the FIGS. 2 and 4 position inside a tubular to be expanded, then the lead cone 26 will not fit unless it is sized smaller than the pipe ID and therefore can be omitted. In those cases the segments are positioned in the FIG. 1 run in configuration and hydraulically moved relative to each other to radially expand the tubular 42, as in FIG. 4, to the maximum swage diameter after which the anchor and stroker assembly that is known can drive the swage assembly that is now in the maximum diameter configuration. The tool configuration that can get the segments to move axially and relatively to each other and to operate to expand using an anchor and a stroker is explained in detail in the two earlier patents discussed above.

The swage assembly 10 of the present invention is designed to hold the predetermined built diameter and to not reduce it for an obstruction so that when expansion is successfully completed a minimum drift diameter will be insured. In going to the built expansion dimension the frictional force to be overcome is reduced due to a greater angular offset of the contacting surfaces between segments and the radial reaction load from the tubular being expanded. Pivoting between segments is reduced from the unique flank and retainer configuration that resembles an arrowhead in shape and features two opposed and spaced preferably acute angles with one of the angles 112 abutting the contact surface 104 and on the opposite end by angle 110 is a sloping surface 122. As a result there is in the aggregate a better restraint against bending between segments 12 and 14 to enhance the movements of the assembly 10 to the built position of FIG. 2 and back to the run in position of FIG. 1 when weight is slacked off the assembly 10 from a pickup force applied to rear retainer 38 from the uphole assembly 40 that supports it.

Figure 8:
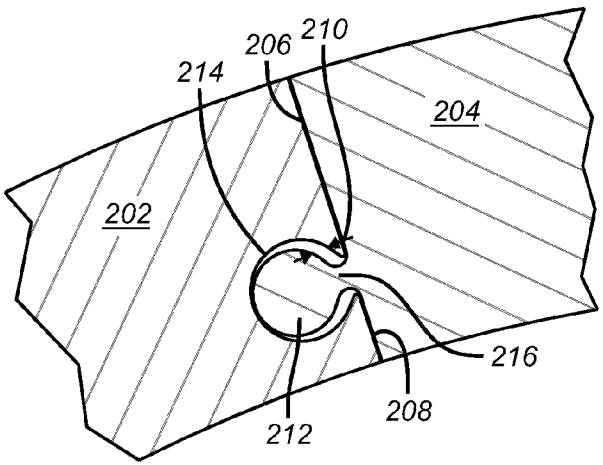
(PRIOR ART) FIG. 8
FIG. 8 is a close up look at the FIG. 6 design with the segments pushed flush together.
Figure 9:
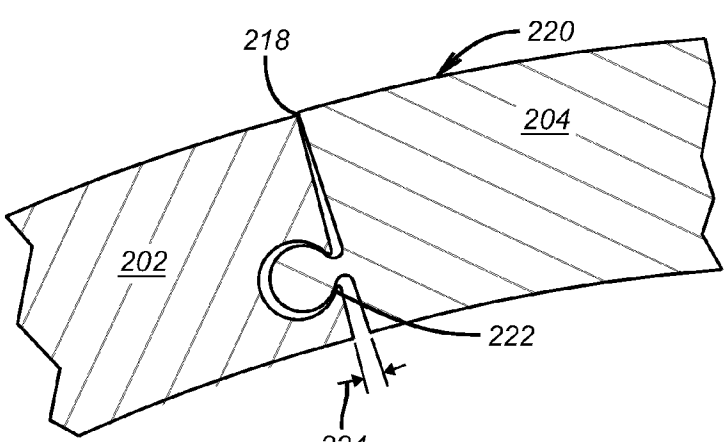
(PRIOR ART) FIG. 9
FIG. 9 is the view of FIG. 8 showing how much segments can bend with respect to an adjacent segment in the prior art design.
Figure 10:
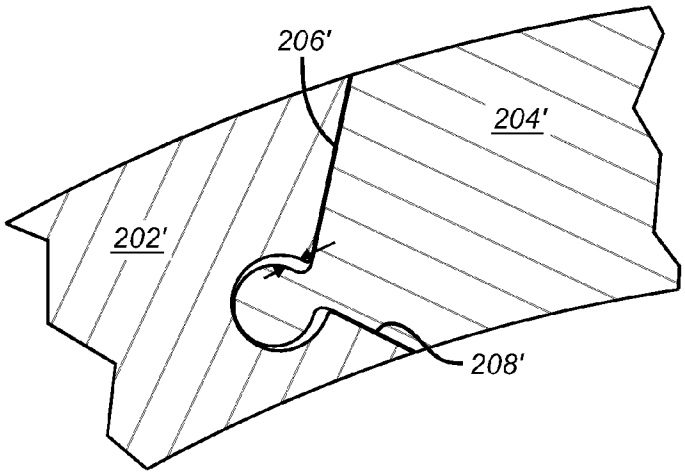
FIG. 10 is the present invention showing the segments flush up against each other.
Figure 11:
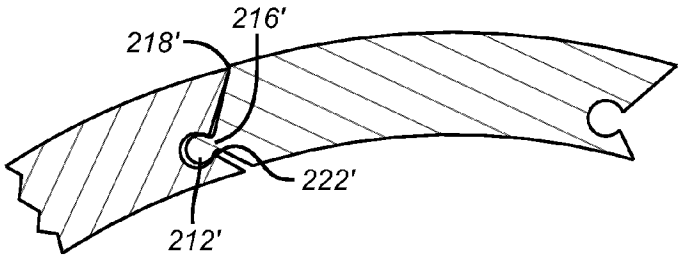
FIG. 11 is the view of FIG. 10 showing how relative bending between adjacent segments is less than in the prior art design of FIG. 9 when building the segments to the expansion diameter.

FIGS. 8 and 9 need to be compared to FIGS. 10 and 11 to illustrate the concept of how the slant cut of the present invention between the segments better keeps them in alignment when being built than the prior art design shown in FIGS. 8 and 9. FIG. 8 shows adjacent segments 202 and 204 pushed together along spaced contact lines 206 and 208 that are in the same plane. Opposed arrows 210 show the potential circumferential gap along contact lines 206 and 208 if the segments separated perfectly in a circumferential line as the ball 212 of segment 204 moved circumferentially until engaging the circular groove 214 until the ball 212 engaged the opening 216 between the spaced contact lines 206 and 208. However, as shown in FIG. 9 while there is relative axial motion between adjacent segments 202 and 204 when the assembly is being built to the expansion dimension, there is also relative bending. It is desirable to minimize this relative bending as the segments can get into a bind as they slide relatively and axially during the building process in a tubular to be expanded. As shown in FIG. 9 the bending between segments is about a pivot point 218 at the outer periphery 220 along a radius from the pivot point 218 to the point 222 where the ball 212 has its motion stopped at gap 216. Opposed arrows 224 indicate the angle quantifying the amount of relative bending between adjacent segments 202 and 204 that is possible.

FIG. 10 is similar to FIG. 8 with the exception that the contact lines are at a sharper angle to the center for all the segments where only segments 202' and 204' are shown. The difference in the designs is better seen comparing FIGS. 9 and 11. In FIG. 11 the pivot radius from pivot point 218' to the point 222' where the ball 212' has its motion stopped at gap 216'. The relative bending between segments in FIG. 11 is less because from the same pivot point the bending radius of the present design in FIG. 11 is longer so that the total angular misalignment is less than in FIG. 9. Here the contact surfaces 206' and 208' are in different planes. The difference can be in the order of about 1 degree of relative bending. Reducing the amount of relative bending when building the segments makes it less likely that they will bind when building or when allowed to go back to the smaller dimension.

The above description is illustrative of the preferred embodiment and many modifications may be made by those skilled in the art without departing from the invention whose scope is to be determined from the literal and equivalent scope of the claims below.

We claim:

1. An adjustable swage assembly for subterranean tubular inside dimension expansion use, comprising:

a plurality of segments interlocked at opposed edges to form a ring selectively relatively movable between a run in dimension and a larger swaging dimension by axial relative movement of a first plurality of said segments toward a second plurality of said segments, said segments retaining said swaging dimension in response to resistance at the tubular inside dimension against collapse toward said run in dimension by axial relative movement of said first plurality of segments away from said second plurality of segments by virtue of the orientation of said interlocking at said opposed edges preventing axial relative movement of said pluralities of segments away from each other.

2. The assembly of claim 1, wherein:

said ring further comprising segments sliding contact at mating flanks such that the axis of relative movement representing the radial versus axial travel intersects a longitudinal axis of said ring to define a rise angle.

3. The assembly of claim 2, wherein:

said segments have a lead swaging surface disposed at a greater angle to said longitudinal axis than said rise angle of said segments.

4. The assembly of claim 3, wherein:

said segments have an alternating orientation of long and short dimensions at opposed ends of said ring and axial relative segment movement to said swaging dimension aligns said lead swaging surfaces among them.

5. The assembly of claim 1, wherein:

said segments form a ring by sliding contact occurring along facing contact surfaces receiving a portion of a normal load from the tubular being expanded, said contact surfaces disposed in a plane inclined more than 180° divided by the number of segments from the direction of said normal load to bear the load from the tubular more directly so that the resulting loads at said contact surfaces and the resulting friction resisting relative motion is reduced.

6. The assembly of claim 5, wherein:

said segments are interlocked at their edges and said contact surfaces are discrete from said interlocking.

7. The assembly of claim 6, wherein:

said interlocking has the shape of an arrowhead.

8. The assembly of claim 6, wherein:

said interlocking comprises at least four adjacent surfaces that form a male component of the interlocking on one segment and a complementary female shape with at least four adjacent surfaces on an adjacent segment.

9. The assembly of claim 8, wherein:

said at least four surfaces define at least a first acute angle.

10. The assembly of claim 9, wherein:

said four surfaces define at least a first and a second acute angles.

11. The assembly of claim 10, wherein:

said first and second acute angles are on opposed sides of a third angle.

12. The assembly of claim 11, wherein:

said first and second acute angles are symmetrically disposed with respect to said third angle.

13. The assembly of claim 12, wherein:

said third angle is at least a right angle.

14. The assembly of claim 6, wherein:

said contact surfaces are in two different planes on opposed sides of said interlocking.

15. The assembly of claim 14, wherein:

said contact surfaces being in different planes reduces the bending between segments when the travel limit in said interlocking is reached as opposes to said contact surfaces being in the same plane.

16. The assembly of claim 1, wherein:

said larger swaging dimension comprises a single largest swaging dimension of said segments.

17. The assembly of claim 1, wherein:

said larger swaging dimension comprises the dimension at which said segments are fully aligned.

18. An adjustable swage assembly for subterranean tubular inside dimension expansion use, comprising:

a plurality of segments selectively relatively movable between a run in dimension and a larger swaging dimension;

said segments form a ring by sliding contact on opposed contact surfaces;

said segments are interlocked at their edges and said contact surfaces are discrete from said interlocking, said interlocking disposed between spaced apart pairs of said sliding contact surfaces;

said interlocking has the shape of an arrowhead featuring two spaced pairs of angled surfaces adjacent an interior and exterior sides of said segments that engage a complimentary shape in an adjacent segment and that define a base portion of said arrowhead shape therebetween.

19. The assembly of claim 18, wherein:

said interlocking comprises at least four adjacent surfaces that form a male component of the interlocking on one segment and a complementary female shape with at least four adjacent surfaces on an adjacent segment.

20. The assembly of claim 19, wherein:

said four surfaces define at least a first and a second acute angles.

21. The assembly of claim 20, wherein:

said first and second acute angles are symmetrically disposed with respect to a third angle, said third angle being at least a right angle.

22. An adjustable swage assembly for subterranean tubular inside dimension expansion use, comprising:

a plurality of segments selectively relatively movable between a run in dimension and a larger swaging dimension and connected to each other with an interlocking feature;

said segments form a ring by sliding contact along a traveling axis with contact occurring along facing contact surfaces on opposed sides of said interlocking feature at the same time receiving a portion of a normal load from the tubular being expanded, said contact surfaces disposed in a plane inclined more than 180° divided by the number of segments from the direction of said normal load to bear the load from the tubular more directly so that the resulting loads at said contact surfaces and the resulting friction resisting relative motion is reduced.

23. The assembly of claim 22, wherein:

said segments are interlocked at their edges and said contact surfaces are discrete from said interlocking.

24. The assembly of claim 23, wherein:

said interlocking comprises at least four adjacent surfaces that form a male component of the interlocking on one segment and a complementary female shape with at least four adjacent surfaces on an adjacent segment.

25. The assembly of claim 23, wherein:

said contact surfaces are in two different planes on opposed sides of said interlocking.

26. The assembly of claim 25, wherein:

said contact surfaces being in different planes reduces the bending between segments when the travel limit in said interlocking is reached as opposes to said contact surfaces being in the same plane.

27. The assembly of claim 22, wherein:

wherein said contact surfaces are in different non-parallel planes and opposed contact surfaces on both sides of said interlocking are in contact at the same time.

28. The assembly of claim 27, wherein:

said segments form a ring by sliding contact at mating contact surfaces such that the axis of relative movement representing the radial versus axial travel intersects a longitudinal axis of said ring to define a rise angle.

29. The assembly of claim 28, wherein:

said segments have a lead swaging surface disposed at a greater angle to said longitudinal axis than said rise angle of said segments along said axis of relative movement.

* * * * *